US006595378B2

(12) United States Patent
Wang

(10) Patent No.: US 6,595,378 B2
(45) Date of Patent: Jul. 22, 2003

(54) COMBINATION DISPLAY RACK

(76) Inventor: Wen-Tsan Wang, PO Box 82-144, Taipei (TW)

( * ) Notice: Subject to any disclaimer, the term of this patent is extended or adjusted under 35 U.S.C. 154(b) by 0 days.

(21) Appl. No.: 09/969,631

(22) Filed: Oct. 4, 2001

(65) Prior Publication Data

US 2003/0066814 A1 Apr. 10, 2003

(51) Int. Cl.[7] ..... A47B 47/00
(52) U.S. Cl. ..... 211/189; 211/194; 211/186
(58) Field of Search ..... 211/189, 186, 211/194, 135; 403/13

(56) References Cited

U.S. PATENT DOCUMENTS 2,279,864 A * 4/1942 Eide ..... 211/189
2,366,677 A * 1/1945 Rosenthal ..... 108/60
4,153,311 A * 5/1979 Takahashi ..... 211/186
4,836,391 A * 6/1989 Bell ..... 211/194
6,422,398 B2 * 7/2002 LaFontaine et al. ..... 211/194

* cited by examiner

*Primary Examiner*—Daniel P. Stodola
*Assistant Examiner*—Erica B Harris
(74) *Attorney, Agent, or Firm*—Leong C. Lei

(57) ABSTRACT

A combination display rack includes a plurality of rack units, and locating pins fitted into respective pin holes in the rack units to secure the rack units to one another, each rack unit including four rectangular sideboards and a bottom board, the sideboards having coupling slots for enabling the sideboards to be coupled to one another, two of the sideboards having a respective coupling groove for the mounting of the bottom board.

1 Claim, 7 Drawing Sheets

COMBINATION DISPLAY RACK

BACKGROUND OF THE INVENTION

The present invention relates to display racks and, more particularly, to a combination display rack, which is inexpensive to manufacture, and easy to set up.

A variety of wooden, metal, and plastic storage racks and display racks are commercially available. These racks occupy much storage space when not in use. In order to eliminate this problem, detachable racks are developed. Regular detachable racks commonly use screws to fasten the parts together. When detaching the rack, the screws must be respectively removed. When setting up the rack again, the screws must be respectively installed again. These mounting and dismounting procedures are complicated, taking much time.

SUMMARY OF THE INVENTION

The present invention has been accomplished under the circumstances in view. It is one object of the present invention to provide a combination display rack, which can easily and rapidly be set up without the use of any screw. It is another object of the present invention to provide a combination display rack, which is composed of a number of detachable rack units subject to the desired dimensions. It is still another object of the present invention to provide a combination display rack, which is formed of multiple detachable rack units each being insertable with a partition board to separate the respective holding space into two separate chambers for holding different items. According to one aspect of the present invention, the combination display rack is comprised of a plurality of detachable rack units, and locating pins fitted into respective pinholes in the rack units to secure the rack units to one another. According to another aspect of the present invention, each rack unit is comprised of four rectangular sideboards and a bottom board. The sideboards have coupling slots such that the sideboards can be coupled to one another. Two of the sideboards have a respective coupling groove for the mounting of the bottom board. According to still another aspect of the present invention, each rack unit further comprises a partition board coupled to two opposite sideboards and perpendicularly stopped at the respective bottom board. The partition board has two parallel coupling slots extended from one peripheral side thereof and respectively coupled to one coupling slot of each of the two opposite sideboards.

DETAILED DESCRIPTION OF THE PREFERRED EMBODIMENT

Figure 1:
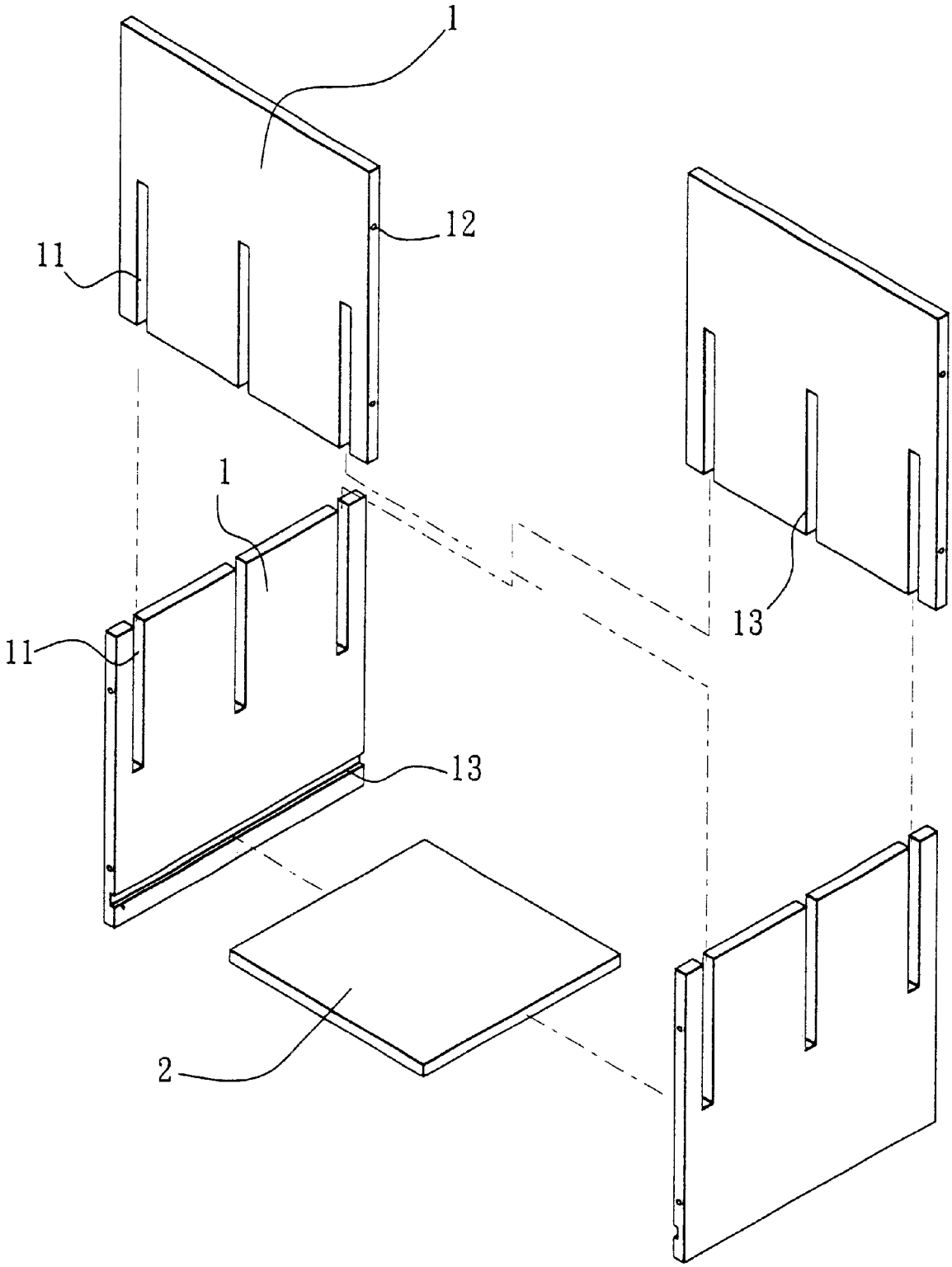
FIG. 1 is an exploded view of a rack unit for a combination display rack according to the present invention (the partition board excluded).
Figure 2:
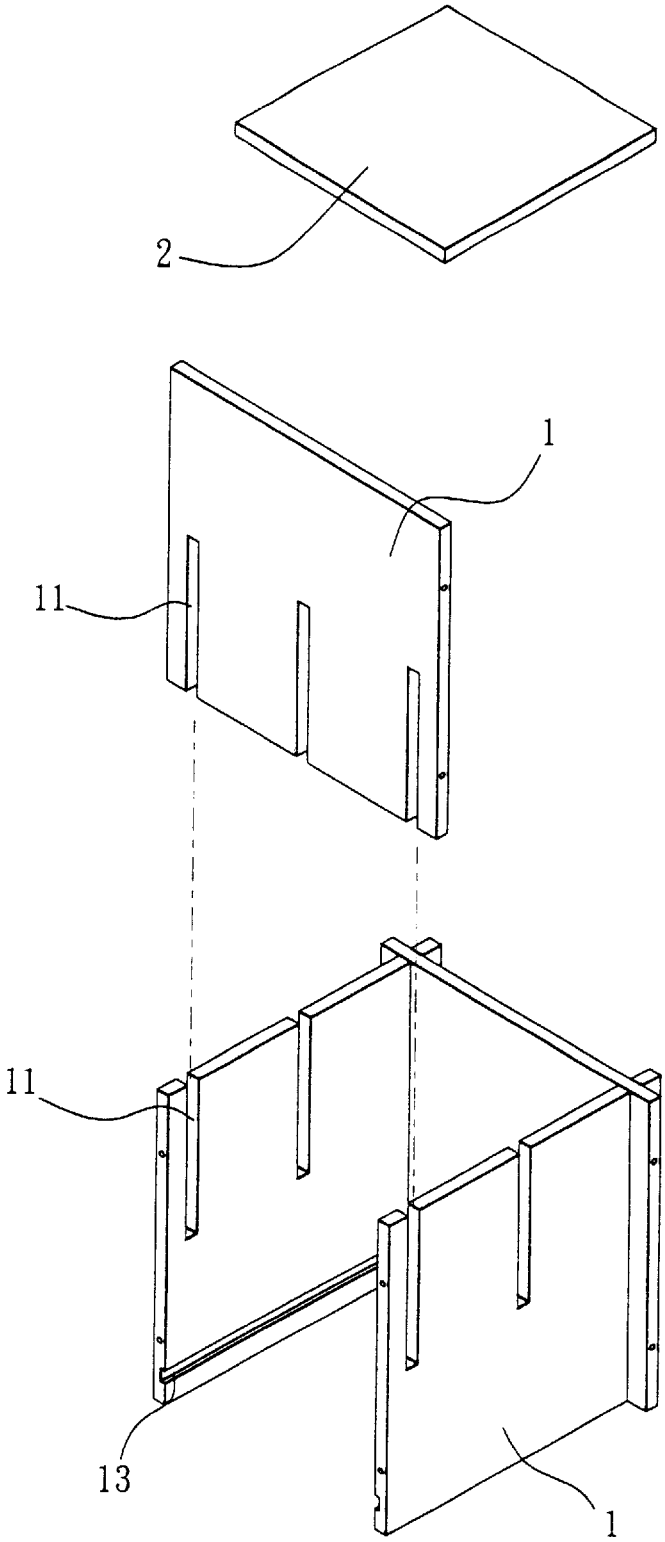
FIG. 2 is an assembly view of FIG. 1 showing three of the sideboards of the rack unit fastened together before the installation of the other sideboard and the bottom board.
Figure 3:
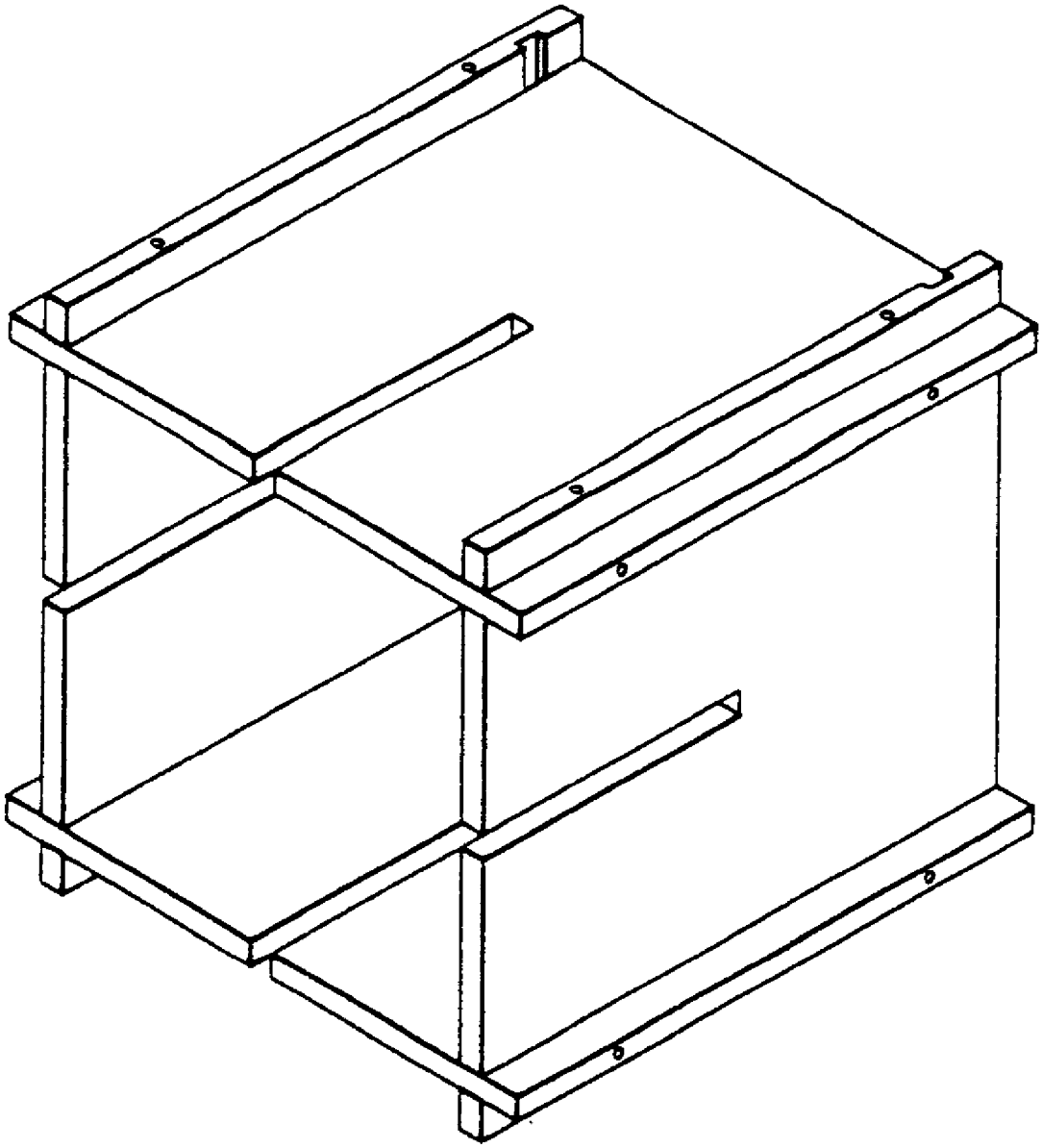
FIG. 3 is an elevational view showing the rack unit of FIG. 1 assembled.

Referring to FIGS. from 1 through 3, a rack unit is shown comprised of four sideboards 1 and a bottom board 2. The sideboards 1 and the bottom board 2 are rectangular boards each having four peripheral sides including two first opposite peripheral sides and two second opposite peripheral sides. Each sideboard 1 has a plurality of parallel coupling slots, for example, three parallel coupling slots 11 perpendicularly extended from one of the first opposite peripheral sides thereof, and a plurality of pin holes 12 symmetrically disposed in the second opposite peripheral sides thereof. The sideboards 1 include two opposite lateral sideboards each having a coupling groove 13 disposed on the inner surface and extended along the other of the first opposite peripheral sides. The four sideboards 1 are fastened together and disposed at the four sides by forcing the coupling slots 11 of one sideboard 1 into engagement with the coupling slots 11 of another. After connection of the sideboards 1, the bottom board 2 is inserted into the coupling groove 13 of each of two opposite lateral sideboards 1.

Figure 4:
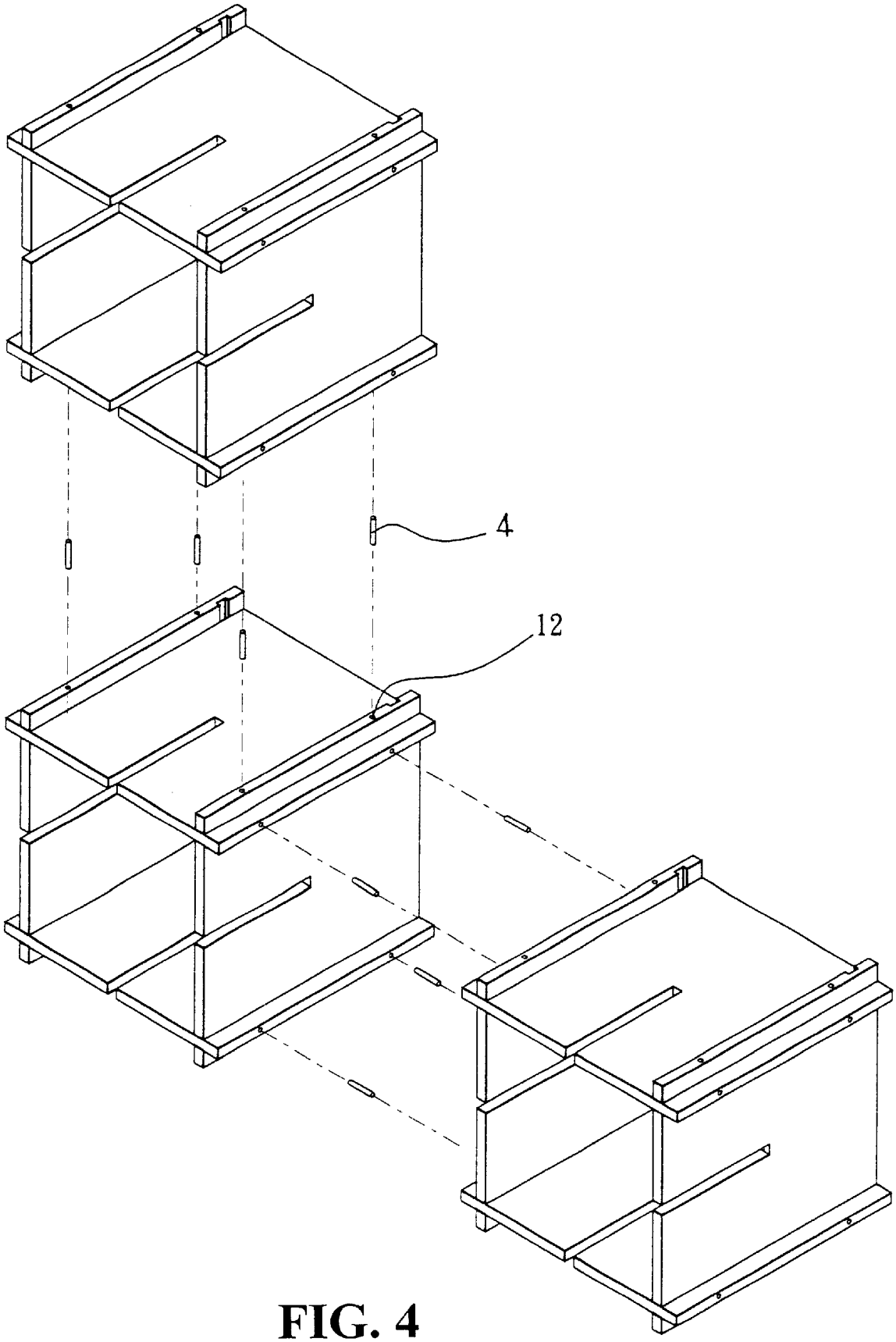
FIG 4 is an exploded view showing the relationship between rack units according to the present invention.
Figure 5:
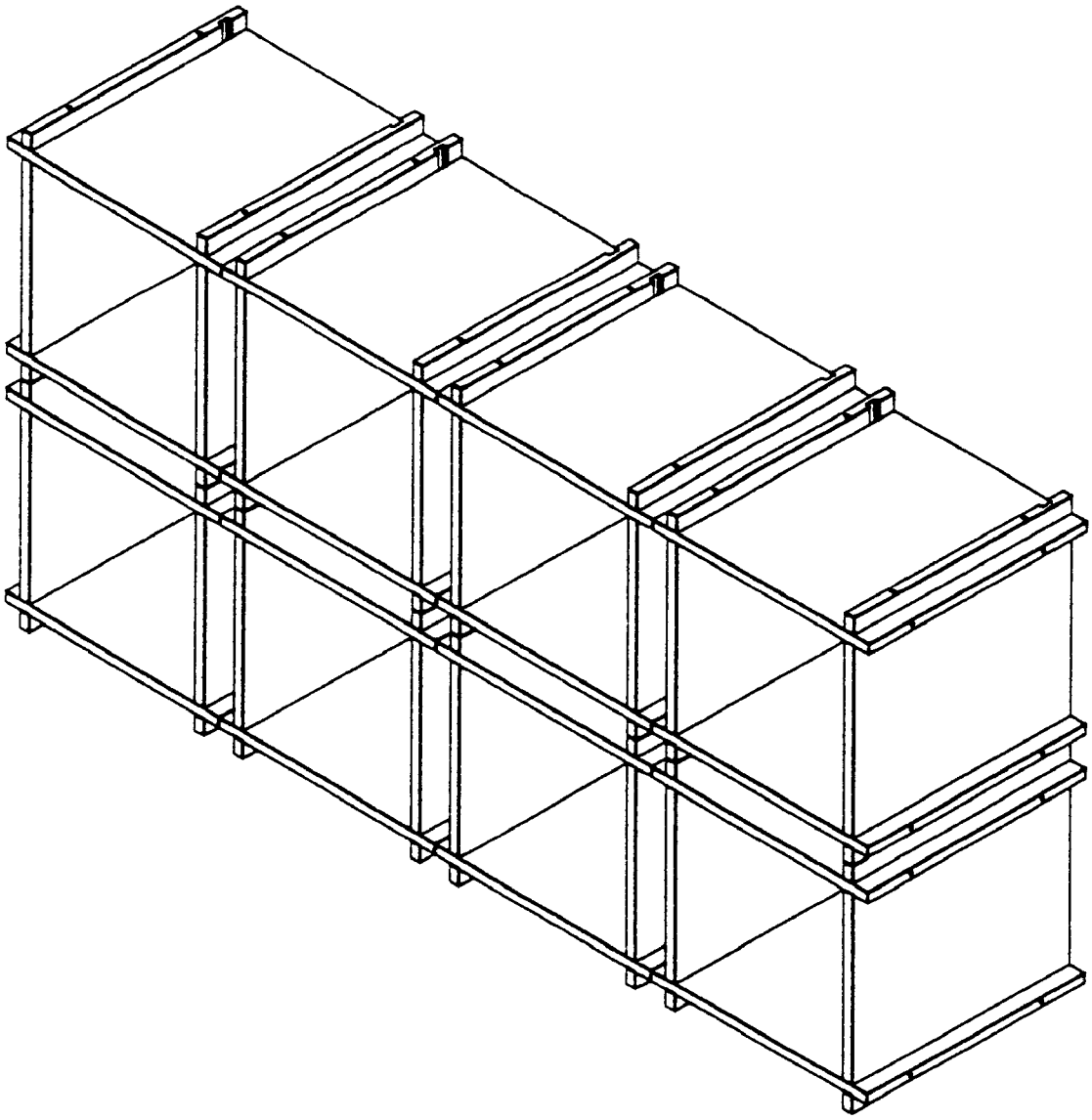
FIG. 5 is an elevational view of a combination display rack according to the present invention.

Referring to FIGS. 4 and 5, by means of engaging locating pins 4 into the pin holes 12 between each two rack units, a plurality of rack units are fastened together, forming a combination display rack.

Figure 6:
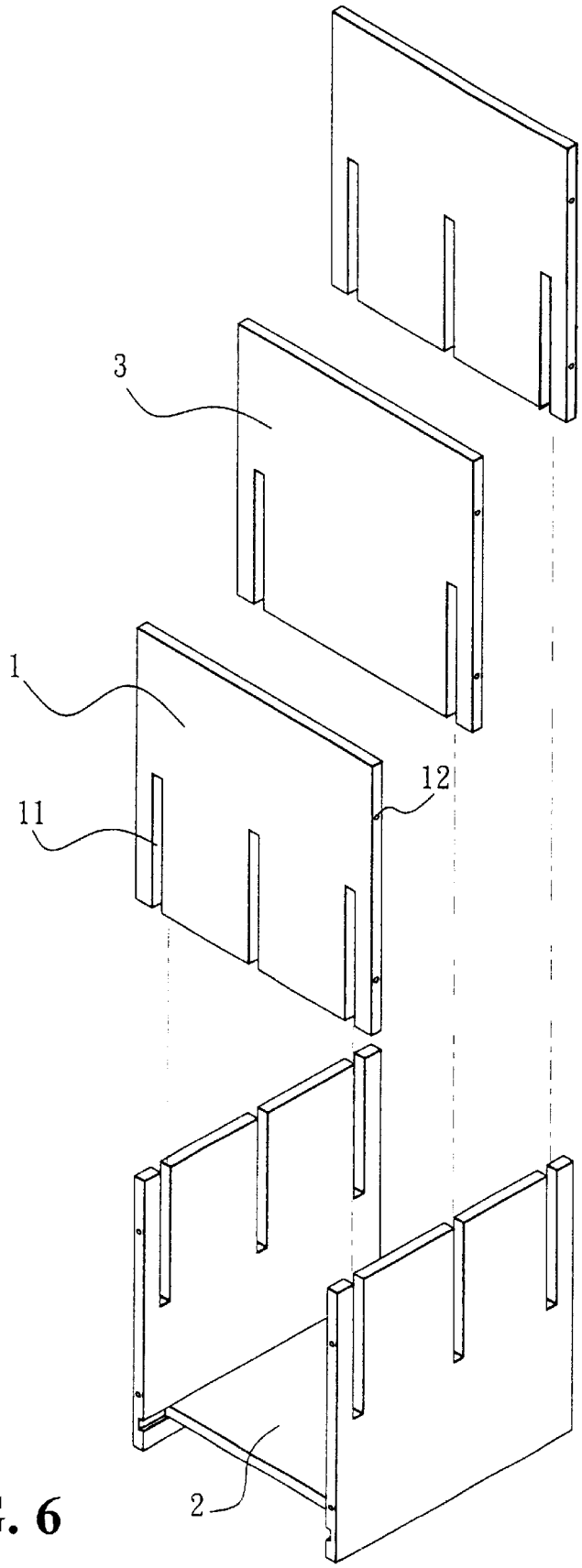
FIG. 6 is an exploded view of a rack unit for a combination display rack according to the present invention (the partition board included).
Figure 7:
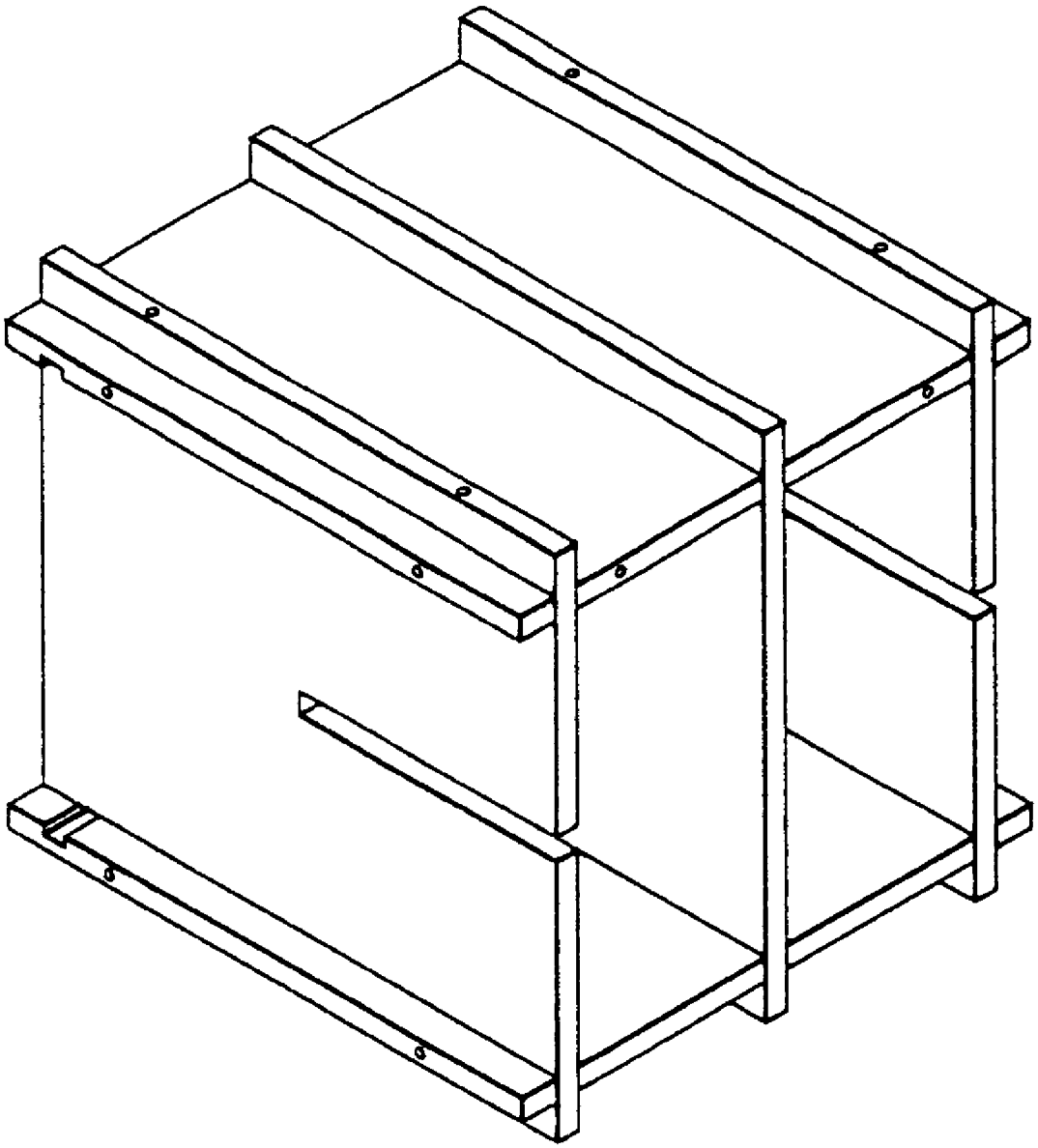
FIG. 7 is an elevational view showing the rack unit of FIG. 6 assembled.

Referring to FIGS. 6 and 7, each rack unit further comprises a partition board 3. The partition board 3 is similar to the sideboards 1 in dimension and structure with the exception of the number of coupling slots 11. According to the present preferred embodiment, the partition board 3 has two coupling slots corresponding to the two outer coupling slots 11 of each sideboard 1. By engaging the coupling grooves of the partition board 3 into the middle coupling slots 11 of each of the two opposite lateral sideboards 1, the partition board 3 is fastened to the sideboards 1 and perpendicularly stopped at the bottom board.

A prototype of combination display rack has been constructed with the features of FIGS. 1~7. The combination display rack functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. The combination display rack comprising a plurality of rack units, and fastening means adapted to fasten said rack units to one another, said rack units each comprising two first opposite rectangular sideboards arranged in parallel, said first opposite rectangular sideboards each comprising two first opposite peripheral sides, two second opposite peripheral sides, a plurality of coupling slots extended from one of the first opposite peripheral sides toward the other of the first opposite peripheral sides, and a coupling groove disposed on an inner surface thereof and extended along the other of the first opposite peripheral sides and spaced from the coupling slots at a distance; two second opposite rectangular sideboards coupled to said first opposite sideboards and arranged in parallel, said second opposite rectangular sideboards each comprising two first opposite peripheral sides, two second opposite peripheral sides, and a plurality of coupling slots extended from one of the first opposite peripheral sides toward the other of the first opposite peripheral sides and adapted to engage the coupling slots of said first opposite rectangular sideboards; and a bottom board inserted into the coupling groove of each of said first opposite rectangular sideboards, wherein the first opposite rectangular sideboards of each of said rack units each have a plurality of pinholes symmetrically disposed in the respective two second opposite peripheral sides; said fastening means are locating pins respectively fastened to the pin holes of said second opposite peripheral sides to secure said rack units to one another, and each said rack unit further comprises a rectangular partition board coupled to the respective first opposite rectangular sideboards between the respective second opposite rectangular sideboards and stopped at the respective bottom board, said partition board having two parallel coupling slots extended from one peripheral side thereof and respectively coupled to one coupling slot of each of the respective first opposite rectangular sideboards.

* * * * *